United States Patent [19]

Van Baerle

[11] 3,982,259

[45] Sept. 21, 1976

[54] PHOTOGRAPHIC MATERIAL PROCESSING MODULE

[76] Inventor: Edward Van Baerle, 676 N. La Salle St., Chicago, Ill. 60610

[22] Filed: Dec. 13, 1974

[21] Appl. No.: 532,452

[52] U.S. Cl. ..... 354/329; 259/72; 354/323

[51] Int. Cl.[2] ..... G03D 3/04

[58] Field of Search ..... 354/323, 327, 328, 329, 354/330; 259/72 R

[56] References Cited

UNITED STATES PATENTS

| | | | |
|---|---|---|---|
| 1,413,651 | 4/1922 | Burnett | 259/91 |
| 3,550,521 | 12/1970 | Carrie | 134/122 P |
| 3,589,264 | 6/1971 | Jensen | 134/119 |
| 3,703,860 | 11/1972 | Wilkinson | 354/329 X |
| 3,739,706 | 6/1973 | Carstens | 354/328 X |
| 3,840,214 | 10/1974 | Merz | 354/330 X |
| 3,905,584 | 9/1975 | Ratowsky | 354/328 X |

*Primary Examiner*—Fred L. Braun
*Attorney, Agent, or Firm*—Edward U. Dithmar

[57] ABSTRACT

A photographic material processing module usable alone for all the processing steps in a processing procedure, or with like modules in side-by-side relation, each module performing one or more of the processing steps. Exposed photographic material is mounted in a cylindrical container having at one end a cover provided with an opening for receiving and discharging processing liquids. The module has a mechanical arrangement for rotating the container a few revolutions in one direction followed by a few revolutions in the opposite direction, and, in preferred form, a mechanism for simultaneously reciprocating the container axially, such movements providing optimum shear relation between processing liquid and photographic material for streak-free processing. A liquid supplying system is provided for feeding measured amounts of processing liquid at proper temperature into the container, and for elevating one end of the container to discharge the processing liquid at the conclusion of a timed processing step. Finally, the module has a transport device for moving the container from the module to an adjacent module at the conclusion of the processing step or steps performed in that module.

6 Claims, 7 Drawing Figures

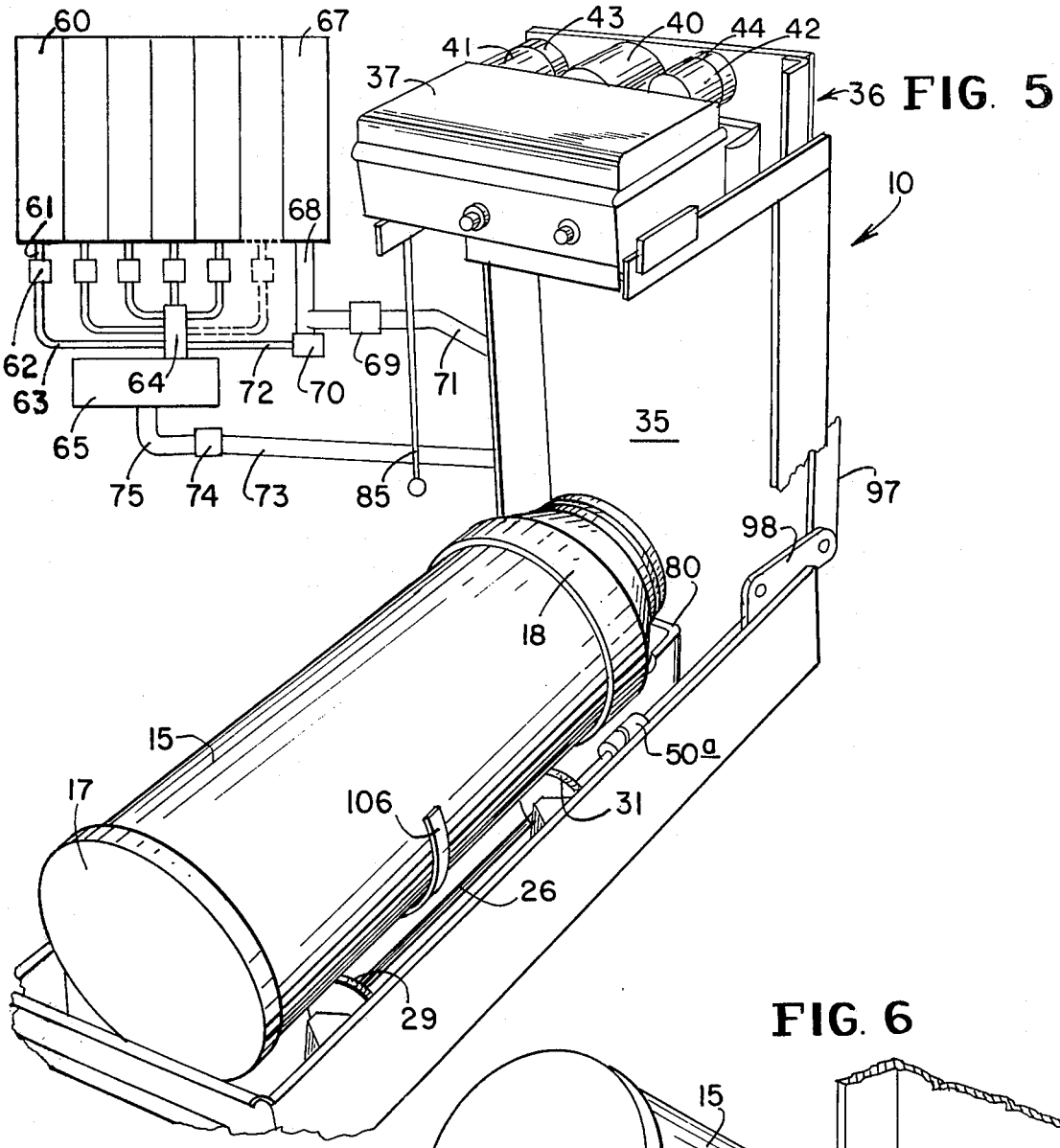
FIG. 5
FIG. 6
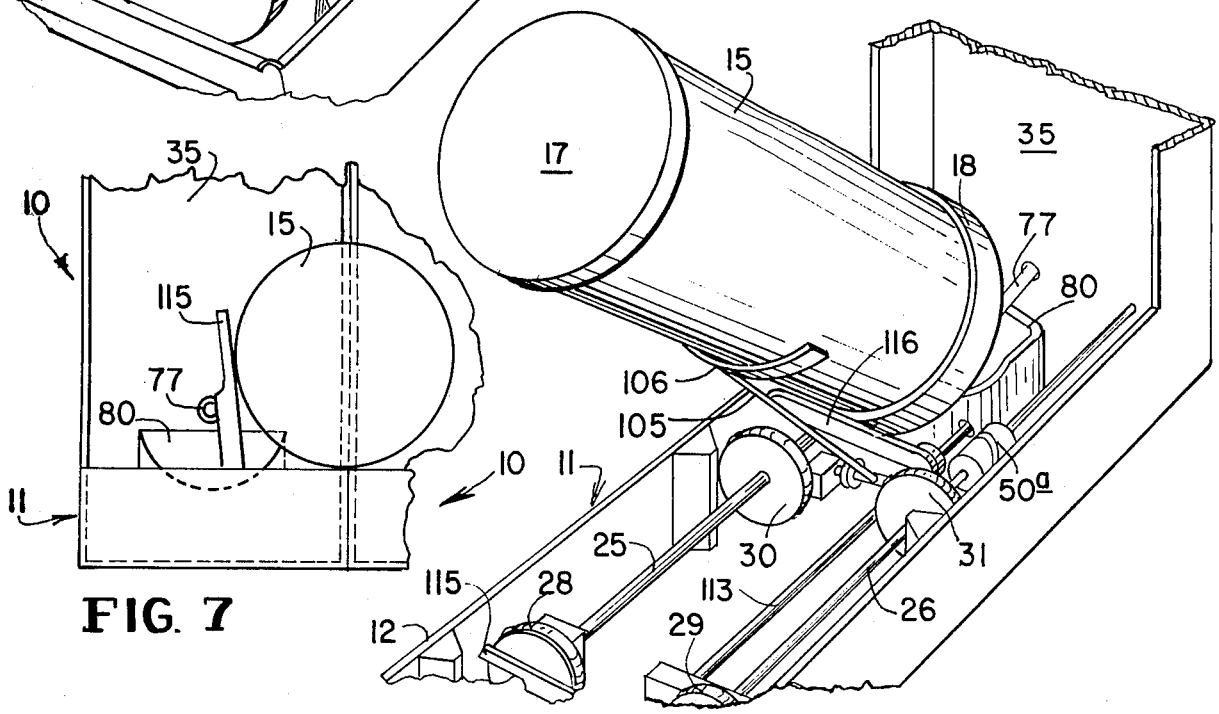
FIG. 7

PHOTOGRAPHIC MATERIAL PROCESSING MODULE

BACKGROUND OF THE INVENTION

This invention relates to photographic material processing apparatus, and more particularly to a processing module usable alone or with like modules arranged in side-by-side relation. The module of the invention is designed for use with exposed photographic material, either black and white or color, and is capable of processing to high and consistent standards of quality.

A user may start with one module at first, and operate the module, manually or automatically, depending on design details, to perform all the steps in a given process. If volume requires, a second module can be added, thereby doubling productivity, as processing steps are performed in both simultaneously, and, later, a third, fourth, etc. module. One or more modules may be associated with a single set of reservoirs for the processing liquids, meaning there need be no duplication of the liquid handling apparatus when the number of modules is increased to accommodate a greater volume of work.

The capability of a module to be joined with one or more additional modules, as mentioned above, renders the use of the modules highly economical from the standpoint of original cost. In addition, a module may be substantially automatic in operation, and a plurality of such modules work together automatically. Thus, labor cost involved in using the modules of the invention is minimal.

The processing modules of the invention are characterized by the ability to process exposed photographic material with a high degree of consistency from one batch of material to the next, and from one module to the next module. As is well known, prior processing units generally have a "personality" of their own, and difficulty is experienced in obtaining consistent results. The present module with its automatic features overcomes the problem of inconsistent performance, even at high volume.

Applicant has been a commercial photographer for many years, and from the beginning has been seeking processing apparatus suitable for his high standards of quality. He has used or is acquainted with most apparatus commercially available in the last 25 years. All process certain shortcomings in meeting his requirements. The present module was developed by applicant in order to achieve his quality standards and overcome the shortcomings of prior apparatus.

DESCRIPTION OF THE PRIOR ART

In the field of photographic processors generally, a number of automatic processors have been developed, as, for example, those shown in U.S. Pat. No. 3,438,317; 3,672,288; 3,695,162 and 3,724,354. None of these processor employs cylindrical containers for holding photographic material wherein processing fluids are fed into the container and the processing takes place within the container.

Some prior apparatus is modular in character with mechanism for transporting photographic material automatically from station to station, or module to module. Such apparatus is shown, by way of example, in U.S. Pat. Nos. 3,559,557 and 3,641,906. Again, cylindrical containers with photographic material and processing fluids therein are not used.

There are, however, prior processing machines that do use cylindrical containers for holding photographic material wherein small quantities of processing fluids are fed into the container, and the processing occurs within the container. Examples of such apparatus are shown in U.S. Pat. Nos. 2,947,236; 3,668,997; 3,682,080; 3,705,544 and 3,709,138.

The present film processing module embodies certain desirable features found in each of the above three categories of prior apparatus, as well as other features, and combines them to provide an improved film processing module possessing extreme flexibility, low initial cost, low operating cost, high quality, high volume, if desired, and highly consistent results. Operation of a module easily can be varied to accommodate future processes.

SUMMARY OF THE INVENTION

A photographic material processing module embodying the invention is usable along for performing all the processing steps in a given procedure, or is usable with one or more like modules arranged in side-by-side relation, the modules each performing one or more of the processing steps simultaneously, thereby increasing production proportionately.

A module includes a support having front and rear portions, and a cylindrical container for holding photographic material, the container including a front cover and a rear cover having an opening for receiving and discharging processing liquids. The support has means for carrying the container and imparting processing movements thereto, namely, rotation through a few revolutions first in one direction and then the other, and, in preferred form, an axial reciprocation. Such movements have been found to establish an optimum shear relation between photographic material and processing liquid, providing streak-free processing.

In preferred form a module includes means for feeding processing liquids automatically into the container, and for discharging liquids from the container, all in accordance with a programmed sequence.

Finally, a module has means for moving the container at the conclusion of a processing step in a first module to an adjacent second module for a subsequent processing step. The transfer movement occurs automatically in response to a programmed setting.

In more detailed aspect, the support structure of one or more modules includes a tray in which the lower portion of the cylindrical container is disposed during its processing movements. The tray has a drain means for receiving and discharging liquid from the container, and, in addition, is designed to receive tempering liquid at predetermined temperature so the temperature in the container may be maintained at desired level.

Other details involve preferred mechanisms for rotating the container, reciprocating the container, tilting the container to discharge fluids and moving the container from one module to an adjacent module.

BRIEF DESCRIPTION OF THE DRAWINGS

FIG. 5 is a front perspective view of the module, partly broken away, the view showing a container in processing position in the module, and further, reservoir, valves and heating and measuring means for supplying processing liquids (chemicals and water) to the module, the latter being shown somewhat diagrammatically.

FIG. 6 is a fragmentary perspective view of the module showing the container in tilted position for the discharge of processing liquid following a processing step.

FIG. 7 is a fragmentary front elevational view on reduced scale of a pair of modules illustrating the automatic transfer of a container from one module to a next module.

DESCRIPTION OF THE PREFERRED EMBODIMENT

Figure 2:
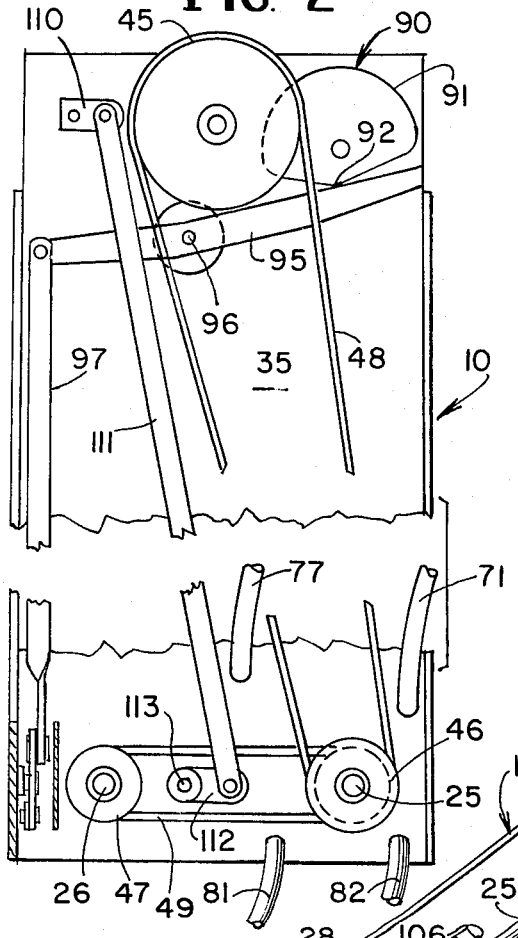
FIG. 2 is a rear elevational view of the module shown in FIG. 1.

Referring to the drawings, a programmed processing module embodying the invention is designated 10 in FIGS. 1, 2, 5, 6 and 7. Module 10 (FIG. 1) includes an elongated support 11 having a front portion 12 and a rear portion 13 which may or may not be parts of a tray. In preferred form, elongated support 11 is a tray supporting various operating parts of the module and adapted to receive a tempering liquid such as water at predetermined temperature to insure that the processing steps preferred in the module will take place at optimum temperature.

As indicated above, a module 10 may or may not be associated with a tray for receiving tempering liquid. Each module 10 includes a support 11 for various parts of the module, and support 11 in preferred form is part of a tray. A single tray may accommodate one module, or a plurality of modules, depending on details of design, but in any event, a tray is not an essential component of a module, although it is a desirable optional component.

A module 10 in use is adapted to rest on a suitable surface at, for example, table height with front portion 12 of support 11 facing the user. The width of a module 10 is comparatively narrow, as indicated generally in the drawings, so a plurality of modules, if desired, can be arranged side-by-side in a comparatively small space. The reservoirs for processing liquids and related liquid handling components, later to be mentioned, are mounted at a remote location, and thus do not increase the width of an installation of modules. As further will be seen, a single set of reservoirs and related components serve either a single module or a plurality of modules, thereby avoiding costly duplication.

Figure 3:
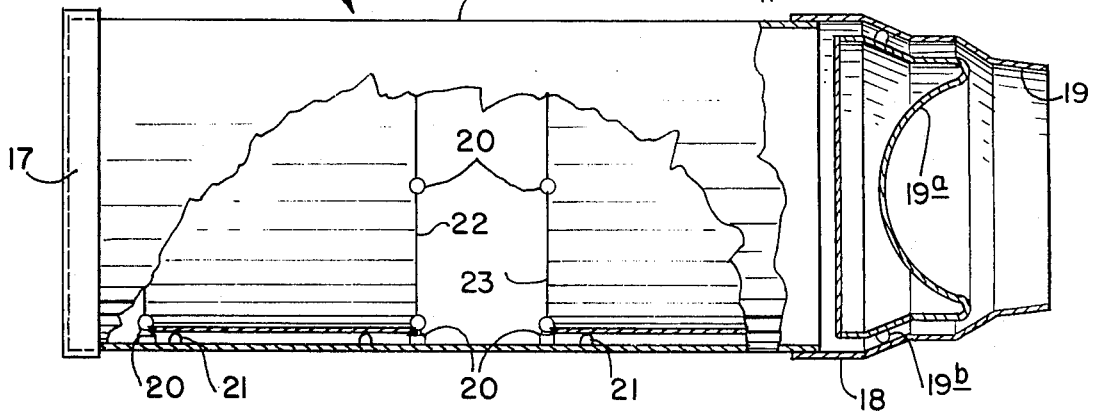
FIG. 3 is an enlarged view of an elongated cylindrical photographic material-holding container used with the module of the invention.

A module 10 handles an elongated cylindrical container 15 (FIGS. 3, 5, 6, and 7) in which exposed photographic material is mounted. Referring to FIG. 3, container 15 includes a light-proof and liquid-proof cylindrical tube 16 preferably having front and rear detachable access covers 17 and 18 at its ends. Front cover 17 provides a light-proof and liquid-proof closure, and the same is true with rear cover 18 at its juncture with tube 16. Rear cover 18, however, in the form illustrated is generally conical in shape, and is provided with an opening 19 at its apex for receiving processing liquids, and for discharging processing liquids when container 15 is tilted, as will be described later. A light trap 19*a* is mounted within rear cover 18, and spaced from the cover by spacers 19*b* to provide a flow path for the liquids.

The interior of tube 16 is provided with a plurality of spaced holders 20 and spacers 21, the holders 20 having reduced neck portions which receive and hold exposed photographic materials 22 and 23 in close relation with the inside surface of the tube. Materials 22 and 23 preferably are mounted with their sensitized surfaces facing inwardly, and spacers 21 are effective to keep the materials out of contact with the tube wall. As will be seen, processing liquid in the small amount necessary for a processing step performed within container 15 is fed into the container and given proper relative movement with the exposed materials 22 and 23 for processing the materials to a high standard of quality. At the conclusion of a processing step, the processing liquid is discharged to a drain, as will be seen.

Continuing with the description of the module 10, a pair of laterally spaced movable shafts 25 and 26 extend from front to rear in support 11, well within the depth of the tray if support 11 is a tray as illustrated in the drawings. Suitable front bearings are provided on support 11 for shafts 25 and 26. In the illustrated form of module 10, the shafts respectively have front rollers 28 and 29 and rear rollers 30 and 31, the rollers being fixed to the shafts. These rollers, of course, might be enlargements of shafts 25 and 26. During processing operation of a module 10, container 15 rests on rollers 28, 29, 30 and 31, as shown in FIG. 5, and is moved rotationally and axially by the rollers and shafts 25 and 26.

Figure 1:
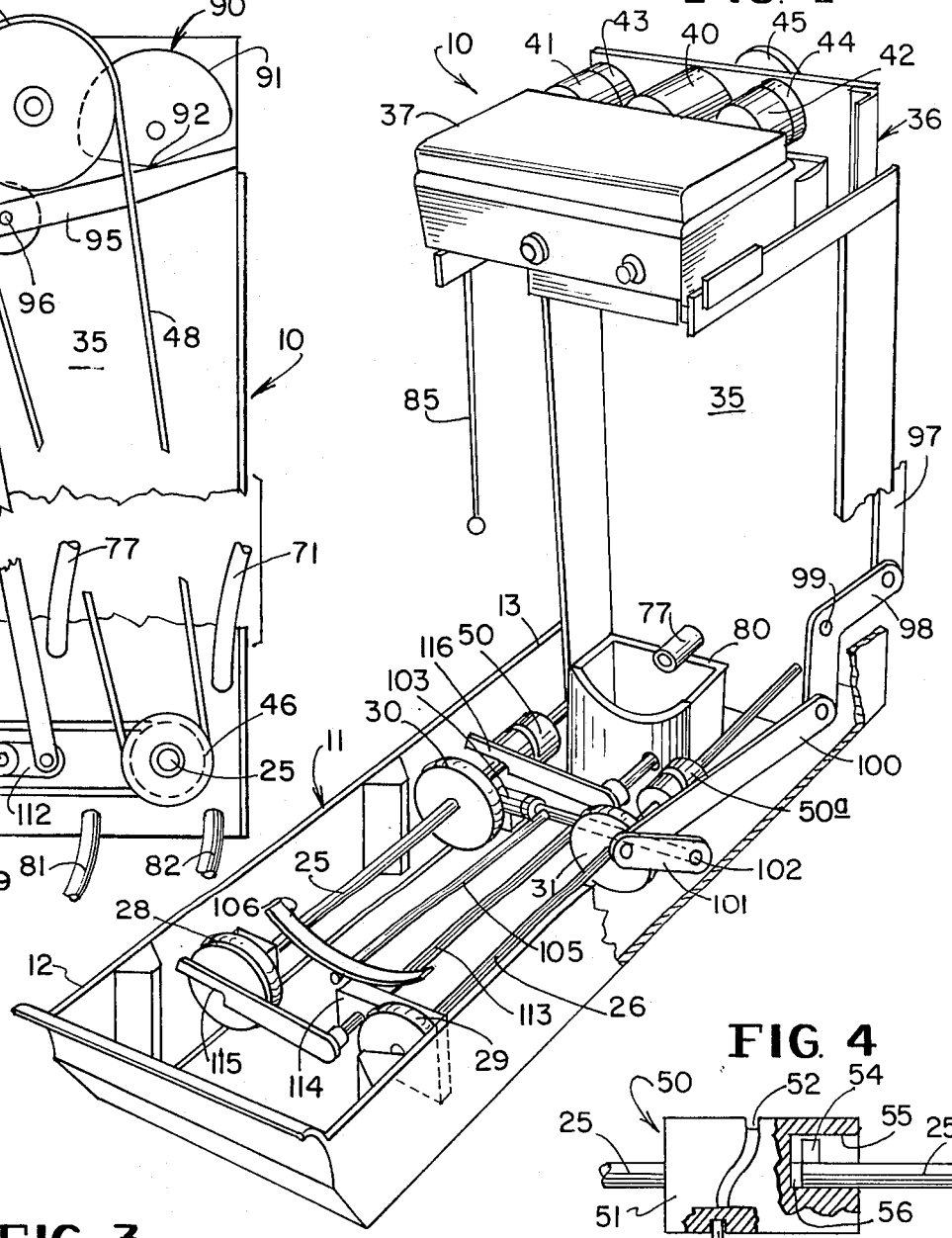
FIG. 1 is a front perspective view, partly broken away, of a photographic material processing module embodying the invention.

Module 10 includes means for rotating shafts 25 and 26 to rotate container 15 a few revolutions in one direction followed by a few revolutions in the opposite direction for timed periods during processing operation of the module. Support 11 at its rear end has a vertical panel 35 carrying a superstructure generally designated 36. As shown in FIG. 1, superstructure 36 includes a housing 37 containing conventional timing motors, cams and switches (not shown) for programming the module, hereinafter sometimes called the programming mechanism. Superstructure 36 carries electric motors 40, 41 and 42, the latter two motors having associated speed reducing mechanisms 43 and 44 respectively.

In the illustrated module, motor 40 drives the two shafts 25 and 26, the motor having a pulley 45 at the rear of panel 35. As shown in FIG. 2, shafts 25 and 26 extend rearwardly through panel 35 and respectively carry pulleys 46 and 47. Pulley 46 has a double track, and one track is connected to motor pulley 45 by belt 48, and the other track is connected to pulley 47 by belt 49. Thus, motor 40 imparts positive rotation to both shafts 25 and 26, a feature found necessary for proper rotation of container 15, particularly when the shaft rollers 28, 29, 30 and 31 and the lower portion of container 15 are immersed in tempering liquid. Container 15 preferably rotates at a rate of about 100 R. P. M.

Motor 40 which drives shafts 25 and 26 is reversible, and suitable conventional switch means (not shown) are provided to control operation of the motor. As mentioned, the motor operates in one direction to cause container 15 to rotate a few revolutions, for example, six, in corresponding direction, followed by a number of revolutions in the opposite direction, and so on during the period of a processing step. The angular position of container 15 when the direction of rotation changes should vary in order to obtain proper processing. If desired, means also may be provided to vary the speed in each direction so the container will rotate at cyclically varying speeds.

As previously mentioned, shafts 25 and 26 and the rollers thereon move back and forth axially so container 15 will move axially in reciprocating manner during the periods of shaft rotation. Illustrated means for imparting axial movement to shafts 25 and 26 respectively are designated 50 and 50*a* in FIG. 1, and a suitable form of means 50 is shown in detail in FIG. 4.

Figure 4:
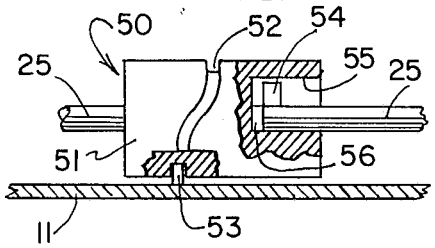
FIG. 4 is an enlarged elevational view, partly broken away and in section, of a cam and clutch means used in the module for imparting rotational and axial movements to the container.

Referring to FIG. 4, means 50, secured to shaft 25, includes a unitary cylindrical cam and clutch member 51 secured to shaft 25. Member 51 has an irregular endless cam recess 52 in its periphery, and support 11 carries a pin 53 that rides in recess 52, causing reciprocating movement of member 51 as the member rotates. Shaft 25 is discontinuous at member 51, the rearwardly extending separate portion of the shaft, also designated 25, having a key 54 riding in a radiala recess 55 in member 51. A cylindrical recess 56 is provided in the member 51 to receive the rearwardly extending shaft 25 which carries previously mentioned pulley 46. As will be understood, cam and clutch member 51 reciprocates back and forth on rear shaft 25 while being keyed thereto by key 54 in radial slot 55, the movement being communicated to the forward shaft 25 and the rollers 28 and 30 mounted thereon. Means 50*a* on shaft 26 is substantially the same as means 50 described above, the cam recess 52 thereof being designed so shafts 25 and 26 move forwardly and rearwardly in synchronism. Rollers 29 and 31, of course, reciprocate with forward shaft 26.

Container 15, as mentioned, rests on shaft enlargements such as rollers 28, 29, 30 and 31 during processing operation, and thus container 15, in addition to having reversing rotatable movement, has axial back and forth or reciprocating movement. The axial reciprocating movement establishes an additional shear relation between the axially reciprocating photographic material in container 15 and the processing liquid which is substantially at rest as far as axial movement is concerned. As will be understood, the inertia of the processing liquid tends to maintain the liquid substantially at rest as to axial movement, despite the axial reciprocation of container 15 and the photographic material mounted therein. Thus, the forces in axial shear between the photographic material and the processing liquid are generated in part by the inertia of the processing liquid and in remaining part by the axial reciprocation of container 15 which, of course, similarly reciprocates the photographic material through the processing fluid. The several movements of the photographic material, namely, rotation in reversing directions and axial reciprocation, have been found to contribute greatly to the substantially streak-free processing performed by module 10.

A module 10, or a plurality of modules 10, has means for feeding measured amounts of processing liquid at predetermined temperature into a cylindrical container 15 on the module through apex opening 19 in rear container cover 18 at timed intervals during operation of the module. Such means are shown diagrammatically in FIG. 5, and it will be understood that the means includes an appropriate number of reservoirs, valves, etc. for the number of modules 10 being served.

Referring to FIG. 5, upper left, the numeral 60 designates one of several comparatively large reservoirs adapted to hold a quantity of processing liquid at room temperature. By way of example, a reservoir 60 may be of such size as to hold a 1 week supply of liquid, it having been found convenient and desirable in some instances to start a week with a fresh supply of liquid. Since liquid in a reservoir 60 is held at room temperature, rather than at elevated processing temperature, there is no significant loss of quality during storage in the reservoir for the 1 week period.

While liquid may be pumped in measured amounts from a reservoir 60 to a module 10, expense and difficulty can be avoided by using a gravity system, as illustrated. Thus, each reservoir 60 has a discharge pipe 61 at the bottom leading to a remotely operated valve 62 which is connected by a pipe 63 to a manifold 64 leading to a heating and measuring receptacle 65. Valve 62, and the other valves in the system are programmed by cam-actuated switches, or the like, contained in housing 37.

Right-hand reservoir 67, as illustrated in FIG. 5, contains water maintained at a predetermined temperature for use in establishing optimum temperatures in the processing steps. Thus, water reservoir 67 has a discharge pipe 68 which branches to two valves 69 and 70. Valve 69 connects with a pipe 71 leading to the tray portion of support 11 whereby a continuing supply of tempering water is fed to the tray. Valve 70 is connected through pipe 72, manifold 64, receptacle 65, pipe 75 and valve 74 to a pipe 73. The pipe 73 extends behind module 10, as shown in FIG. 5, and connects with a feed pipe 77 (FIGS. 1, 2 and 6) which directs liquid (processing chemicals and water) into container 15 as called for by the programming mechanism in housing 37 which operates the various valves 62, 70 and 74.

Previously mentioned heating and measuring receptacle 65 receives processing liquid from a reservoir 60 in predetermined amount, the receptacle having a suitable float switch (not shown) or other mechanism which closes reservoir valve 62 when the proper amount of liquid has been admitted. In subsequent processing steps, receptacle 65 will receive processing liquid from other reservoirs 60 in measured amount, which amount in each case is that required for the programmed processing step next performed in a film holding container 15.

Water from reservoir 67, valve 70 and pipe 72 flushes receptacle 65 between charges of other processing liquids.

Heating and measuring receptacle 65 includes means for quickly raising the temperature of the measured quantity of processing liquid in the receptacle from the room temperature of the liquid in reservoir 60 to the temperature required for the processing step in container 15. This heating function may be performed by means of water at predetemrined temperature from reservoir 67 which is conducted to a heat exchanger (not shown) forming a part of receptacle 65. Other suitable heat sources, such as an electric heater, for example, may be used in receptacle 65 to raise the temperature of the processing liquid quickly to optimum processing temperature.

The foregoing arrangement for heating small quantities of processing liquid just prior to use is highly advantageous compared with the conventional arrangement wherein all the liquids in the several reservoirs 60 are maintained at elevated processing temperatures. With the present arrangement, less heaters are required, and, more importantly, the processing liquids are not brought to processing temperature until just prior to use. If the liquids in reservoirs 60 were maintained at processing temperatures for any length of time, even during the length of a day, quality would deteriorate, thereby necessitating the addition of new liquids, or changes in the programming.

When the measured amount of processing liquid in receptacle 65 reaches processing temperature, as it does quickly, valve 74 is opened, and liquid feeds through pipe 73 (FIG. 5) and behind panel 35 to pipe 77 (FIG. 2) which extends through panel 35 to the front of the panel, as shown in FIG. 1.

Still referring to FIG. 1, support 11 at the rear includes a centrally located drain means 80 (also shown in FIGS. 5 and 6) which at the bottom has a rear discharge pipe 81 (FIG. 2). Near discharge pipe 81 is a second discharge pipe 82 leading from the tray portion of support 11. Pipe 82 may discharge tempering water more or less continuously from the tray, as fresh tempering water at processing temperature is fed to the tray through pipe 71 to maintain optimum processing temperature in container 15 which in part rests in the tempering water.

Referring again to FIG. 5, module 10 is shown with a container 15 in processing position. As will be seen later, container 15 may have been transported automatically into module 10, as would be the case with the second and subsequent ones of a plurality of modules. In the case of a single module, or the first of a series, container 15 is placed in the module manually.

Suitable means is provided to initiate the series of processing steps programmed by the mechanism contained in housing 37. In the illustrated module 10, a switch arm 85 (FIGS. 1 and 5) extends downwardly from the left end of housing 37. If container 15 is transported automatically into module 10, the container on entering the modules engages the lower end of switch arm 85 and automatically initiates the series of steps programmed for that module. If the container is positioned manually, the operator simply manually actuates the switch arm 85.

When the step or series of steps in module 10 is initiated, motor 40 (FIGS. 1 and 5) is energized to impart rotary motion to container 15 for a few revolutions in one direction followed by a few revolutions in the other direction, etc., as well as impart the axial reciprocation provided by the means 50 shown in FIG. 4.

Processing liquid at predetermined temperature from receptacle 65 is directed through pipe 77 into the apex opening 19 (FIG. 3) of container 15. The liquid covers the lower portion of the exposed photographic materials 22 and 23 in container 15, and the aforesaid movements of container 15 provide optimum shear relation between liquid and materials for streak-free processing.

At the conclusion of a processing step, as determined by the setting of the programming mechanism in housing 37, container 15 is elevated at its forward end as shown in FIG. 6, and the processing liquid is discharged through apex opening 19 to drain means 80 from whence the liquid exits through rear discharge pipe 81 (FIG. 2). The illustrated mechanism for elevating container 15 now will be described.

Referring to FIGS. 1 and 2, motor 41 on superstructure 36 and associated speed reducing mechanism 43 drive a cam 90 (FIG. 2) at the rear of panel 35 through one revolution. Cam 90 has a "high" peripheral portion 91 extending through about 180°, and a "low" portion 92.

A lever 95 (FIG. 2) pivoted to panel 35 at 96 has one end portion in engagement with cam 90, and the other end portion pivotally connected to a link 97. Referring to FIG. 1, link 97 is pivotally connected to one arm of a lever 98 which is pivoted at 99 to support 11. The other arm of lever 98 is pivotally connected to one end of a link 100, the other end of the link being pivotally connected to a crank arm 101 secured to a shaft 102 extending transversely of support 11. Shaft 102 is mounted for rotation in suitable bearings, one of which is shown at 103 in FIG. 1.

Shaft 102 carries a central arm 105 extending at right angles to shaft 102 and longitudinally of support 11, the arm 105 extending toward the front of module 10. A container-engaging means such as cradle 106 is carried at the forward end of arm 105, the arm and cradle cooperating to elevate container 15 as shown in FIG. 6.

Referring back to FIG. 2, cam 90 is shown in rest position with "low" portion 92 in engagement with lever 95. The aforesaid links and levers extending between lever 95 and transverse shaft 102 are such that cradle 106 is out of engagement with container 15, and the container rests on rollers 28, 29, 30 and 31, which rollers, as previously mentioned, impart rotational and axial movements to the container.

When motor 41 is energized by the programming mechanism in housing 37, cam 90, as mentioned, rotates through one revolution. During much of the revolution "high" portion 91 engages lever 95 and through the previously described links and levers rotates transverse shaft 102 through about 45 degrees, thereby elevating container 15 as shown in FIG. 6 to discharge the processing liquid to drain means 80.

Completion of the one revolution of cam 90 restores container 15 to horizontal position as shown in FIG. 1. Container 15 at this time then receives the next charge of processing liquid, for example, rinse water, called for by the programming mechanism in housing 37. The rotary and axial movements of container 15 are resumed as soon as the container is received on the rollers 28–31.

At the conclusion of the processing step or steps in a module 10, container 15, if there is a next module in side-by-side relation, is ready to be moved from the first module to the next. The illustrated mechanism for transporting the container automatically to the next module now will be described.

Referring first to FIGS. 1 and 2, motor 42 and associated speed reducing mechanism 44 on superstructure 36 drive a first crank arm 110 (FIG. 2) at the rear of panel 35. A link 111 has one end pivotally connected to crank arm 110 and the other end pivotally connected to a second crank arm 112 carried by longitudinal shaft 113 which extends through panel 35 and drain means 80 (FIG. 1) to a bearing 114 located forwardly in support 11. Shaft 113 carries a forward arm 115 and a rearward arm 116, the two arms underlying container 15 when the latter is in the horizontal position shown in FIG. 5.

When the programming mechanism in housing 37 calls for moving container 15 from one module 10 to the next, motor 42 is energized to rotate crank arm 110 counterclockwise through about 90°. This action causes shaft 113 to rotate, looking at the front in FIGS. 1 and 7, through about a quarter revolution in clockwise direction, thereby elevating arms 115 and 116, as shown in the case of arm 115 in FIG. 7. This movement of arms 115 and 116 moves container 15 from its horizontal position on rollers 28–31 of one module 10 to corresponding position in adjacent module 10. As previously mentioned, container 15 in so moving engages switch arm 85 (FIGS. 1 and 5) of the next module to initiate the processing step or steps performed at the next module. Suitable limit switches (not shown) are provided to reverse motor 42 at the 90° position of crank arm 110, and to stop the motor when the rest position of arms 115 and 116 is reached.

From the above description it is thought that the construction and advantages of this invention will be readily apparent to those skilled in the art. Various changes in detail may be made without departing from the spirit or losing the advantages of the invention.

Having thus described the invention, what is claimed as new and desired to secure by Letters Patent is:

1. A photographic material processing module usable with a like module arranged in adjacent side-by-side relation, comprising:

a support having front and rear portions;

a cylindrical container for holding photographic material on the inside thereof, said container including a front cover and a rear cover having an opening for receiving and discharging processing liquids;

means on said support for positioning said container horizontally and for imparting processing movements thereto;

means on said support for feeding processing liquid into said container;

means on said support for discharging liquid from said container; and means on said support for moving said container at the conclusion of a processing step in a first module to an adjacent second module for a subsequent processing step, said means for moving said container including a transport shaft mounted for rotation on said support and extending from front to rear, said transport shaft having container engaging means, a reversible electric motor, means connecting said motor to said transport shaft in driving relation and switch means causing said motor to rotate said transport shaft back and forth through a quarter revolution, whereby said container engaging means during shaft rotation in one direction engages and moves said container from one module to the next.

2. The module of claim 1 with the addition of means including a switch arm on said support for initiating a cycle of module operation when said switch arm is engaged by a container being moved into the module.

3. A photographic material processing module usable alone or with like modules arranged in adjacent side-by-side relation, comprising:

a support having front and rear portions;

a cylindrical container having a cylindrical wall for holding photographic material on the inside thereof in closely spaced relation with the cylindrical wall, said container including a front cover and a rear cover having an opening for receiving and discharging processing liquids;

a pair of laterally spaced shafts mounted for rotation on said support and extending from front to rear, said container being positioned horizontally on said shafts;

means for rotating said shafts to rotate said container a few revolutions in one direction followed by a few revolutions in the opposite direction during operation of the module;

means on said support for feeding processing liquid into said cylindrical container through said rear cover opening; and means on said support for elevating the front end of said cylindrical container to discharge processing liquid through said opening, said means for elevating including an electric motor, a cam driven through one revolution by said motor, a first lever pivoted on said support and actuated by said cam, a transverse shaft mounted for rotation on said support below said container, a longitudinal arm extending from said transverse shaft below said container, a container engaging cradle at the free end of said arm below the front portion of said container, and links and levers connecting said first lever and said transverse shaft, whereby said cam is effective to elevate said cradle and thus the front portion of said container, hold same elevated for discharge of the processing liquid and return same to starting position.

4. A photographic material processing module usable with a like module arranged in adjacent side-by-side relation, comprising:

a support having front and rear portions;

a cylindrical container having a cylindrical wall for holding photographic material on the inside thereof in closely spaced relation with the cylindrical wall, said container including a front cover and a rear cover having an opening for receiving and discharging processing liquids;

a pair of laterally spaced shafts mounted for rotation on said support and extending from front to rear, said container being positioned horizontally on said shafts;

means for rotating said shafts to rotate said container a few revolutions in one direction followed by a few revolutions in the opposite direction during operation of the module;

means on said support for feeding processing liquid into said cylindrical container through said rear cover opening;

means on said support for elevating the front end of said cylindrical container to discharge processing liquid through said opening; and means for moving said container at the conclusion of a processing step in a first module to an adjacent second module for a subsequent processing step, including a transport shaft mounted for rotation on said support and extending from front to rear, said transport shaft having container engaging means, a reversible electric motor, means connecting said motor to said transport shaft in driving relation and switch means causing said motor to rotate said transport shaft back and forth through a quarter revolution, whereby said container engaging means during rotation of the transport shaft in one direction engages and moves said container from one module to the next.

5. The module of claim 4 wherein said pair of laterally spaced shafts also are mounted for reciprocating axial movement on said support, and with the addition of means for axially moving said spaced shafts and thus said container in reciprocating manner during rotation of said spaced shafts, whereby optimum shear relation is established between the processing liquid and the photographic material within said container, providing substantially streak-free processing.

6. The module of claim 5 wherein said means for axially moving said laterally spaced shafts in reciprocating manner includes a cam means and clutch means on each shaft and pin means on said support engaging each said cam means, said spaced shafts being discontinuous at said clutch means, whereby the portions of said spaced shafts which position said container reciprocate in response to action of said cam means and said pin means.

* * * * *